US005866221A

United States Patent [19]

Owen et al.

[11] Patent Number: 5,866,221

[45] Date of Patent: Feb. 2, 1999

[54] IMPREGNATED AND SERRATED CUTTING STRIP FOR A CARTON

[75] Inventors: Edwin Wyn Owen, Coventry; Ian Jamie, Warwickshire, both of Great Britain

[73] Assignee: Carton Edge Limited, Coventry, Great Britain

[21] Appl. No.: 765,546

[22] PCT Filed: May 8, 1996

[86] PCT No.: PCT/GB96/01095

§ 371 Date: Mar. 18, 1997

§ 102(e) Date: Mar. 18, 1997

[87] PCT Pub. No.: WO96/35574

PCT Pub. Date: Nov. 14, 1996

[30] Foreign Application Priority Data

| | | | |
|---|---|---|---|
| May 12, 1995 | [GB] | United Kingdom | 9509625 |
| Oct. 18, 1995 | [GB] | United Kingdom | 9521331 |
| Mar. 14, 1996 | [GB] | United Kingdom | 9605375 |

[51] Int. Cl.[6] ..... B65H 35/00

[52] U.S. Cl. ..... 428/41.1; 83/169; 83/613; 225/43; 225/49; 225/91; 428/34.2; 428/41.8; 428/192; 428/194

[58] Field of Search ..... 428/41.1, 41.8, 428/34.2, 192, 194; 225/43, 91, 49; 83/169, 613

[56] References Cited

U.S. PATENT DOCUMENTS 5,135,784 8/1992 Okumura ..... 428/34.2

*Primary Examiner*—Nasser Ahmad

*Attorney, Agent, or Firm*—Clifford W. Browning; Woodard, Emhardt, Naughton, Moriarty & McNett

[57] ABSTRACT

A serrated cutting strip (26) for a carton comprises paper or board impregnated with a mix of acrylic resin and urea formaldehyde. The strip is 0.2 to 0.5 mm in thickness and can bend without cracking over a bar of 20 mm diameter. The strip has adhesive on one side and a release sheet (28) on the adhesive. The strip is applied to a carton by apparatus (10) which comprises rollers (44,45) for advancing a substrate sheet (24), a cutter (12) and means (44,45) for drawing a release sheet (28) away from the edge (46).

7 Claims, 1 Drawing Sheet

IMPREGNATED AND SERRATED CUTTING STRIP FOR A CARTON

The invention relates to a serrated cutting strip for a carton, the use of a material in the formation of the strip and a method and apparatus for applying a cutting strip to a carton.

BACKGROUND OF THE INVENTION

It is known to apply a metal cutting strip to a carton for cling film so that cling film withdrawn from the carton can be cut on the metal cutting strip. The metal strip may be applied by a machine such as a Faustel D17 Edger. In the machine, metal sheet from a roll is advanced by passing between driven rollers. The sheet enters a guide comprising a shallow slot. The guide is angled downwardly at its end and directs the sheet between a block and a lower die. An upper die is movable to cut the sheet. The upper die also includes pins which pass through the block and lower die to perforate the sheet before it is cut. This perforating action leaves downwardly extending teeth around each perforation. When the upper die has cut a strip from the sheet, the strap is held onto the die by suction and is carried down onto a carton blank where the pressure of the upper die forces the teeth into the carton to mechanically fix the metal strip to the carton.

The known method is relatively slow and the metal strip blunts the dies relatively quickly so that they must be re-sharpened.

SUMMARY OF THE INVENTION

According to one aspect of the invention there is provided a method of applying a cutting strip to a carton comprising advancing a substrate comprising a sheet of cutting strip material having adhesive on one side thereof and a release sheet over the adhesive, peeling away the release sheet in front of a cutter, cutting the cutting strip material into a strip with the cutter, and, bringing the adhesive carrying side of the strip into contact with the carton.

In this way, the substrate material need not be metal, but can be any suitable desired material which may, for example, be easier to cut than metal. Also, the perforation step of the known method is not required. The omission of this step and the ability to use material which is easily cut means that productivity can be greatly increased by means of the method of the invention.

Preferably, the release sheet is peeled away just in front of the cutter. This avoids the possibility of the adhesive carrying side of the cutting strip material collecting dust or debris, or becoming affixed to the machine before it is cut and applied to the carton.

The substrate may be advanced in any suitable way and in a preferred embodiment, the substrate is advanced by pulling the part of the release sheet which has been peeled away from the cutting strip material.

Preferably, a light evaporation oil is applied to the cutting strip material prior to the cutting step. This lubricates the cutting operation.

According to another aspect of the invention there is provided apparatus for carrying out the method of the first aspect of the invention.

According to a further aspect of the invention there is provided a Faustel D17 Edger machine having an extension on the lower wall of the feed material guide slot, the extension extending the lower wall and providing an edge for peeling at a position adjacent the path of the cutting die.

The normal Faustel D17 Edger machine has a guide slot which terminates too far from the path of the cutting die to avoid sticking problems if the edge of the lower wall of the guide slot is used to peel back the release sheet. The use of an extension enables a cutting strep material with a release sheet to be used effectively.

Preferably, means is provided for applying a high evaporation oil to the feed material before it enters the machine.

According to another aspect of the invention there is provided apparatus for cutting and applying a cutting strip to a carton from a substrate comprising a sheet of cutting strip material having adhesive on one side thereof and a release sheet over the adhesive, the apparatus comprising means for advancing a substrate sheet, a cutter, an edge in front of the cutter and means for drawing a release sheet away from the edge.

Preferably, the edge is immediately in front of the cutter.

The advancing means and the drawing means may be distinct, but preferably the advancing means comprises the drawing means. The drawing means may comprise a pair of rollers.

The apparatus may be any suitable apparatus and may be a Faustel D17 Edger for example. In that case, the drawing means and advancing means preferably comprise the feed rollers of the machine.

The apparatus preferably further includes means for applying a high evaporation oil to a cutting strip material.

The cutting strip material may be of any suitable type and may comprise any impregnated paper or board and/or may comprise a mix of acrylic resin and urea formaldehyde with a structural filler such as paper or board. This gives sufficient stiffness for use as well as enabling sufficiently strong and sharp teeth to be cut onto its edge.

According to a further aspect of the invention there is provided a serrated cutting strip for a carton, the strip comprising an impregnated paper or board.

Preferably the strip comprises an impregnated paper. The paper or board may be impregnated with resin. The paper or board may be impregnated with one or preferably both of acrylic resin and urea formaldehyde. Further resins which may be degradable may also be impregnated The strip preferably has adhesive on one side thereof and may have a release sheet over the adhesive.

The cutting strip is preferably recycable with the box which may be made of cardboard or corrugated carton material.

The impregnation may add 42.5 to 67.5% by weight of additional material.

According to another aspect of the invention there is provided a serrated cutting strip for a carton, the cutting strip comprising a mix of acrylic resin and urea formaldehyde with a structural filler such as paper or board.

The strip may comprise 60 to 70% by weight of structural filler.

Viewed from another aspect the invention provides the use of a material comprising a mix of acrylic resin and urea formaldehyde with a structural filler such as paper or board in the formation of a cutting strip for a carton.

Viewed from a further aspect the invention provides the use of a material comprising an impregnated paper or board in the formation of a cutting strip for a carton.

The material may contain not less than 65% paper. The material may be 0.2 to 0.5 mm in thickness, preferably 0.25 to 0.4 mm thickness. The strip may be capable of bending without cracking over a bar of 20 mm diameter.

According to yet another aspect of the invention, there is provided a cutting strip for a carton, the strip being from 0.2 to 0.5 mm in thickness and being capable of bending without cracking over a bar of 20 mm diameter.

This combination of strength and flexibility is particularly important and beneficial.

The strip may be less than 0.4 mm thickness and may bend without cracking over a 12.5 mm diameter bar. The strip preferably complies with Indent Test BS 6222 1988 Impact. The strip may additionally or alternatively comply with Scrape Test BS 6222 1988 3.0N. The strip may additionally or alternatively comply with Bond Test BS 6250 Part 3 Grade 4.

The strip may be provided with adhesive on one side thereof and has a release sheet over the adhesive.

Figure 1:
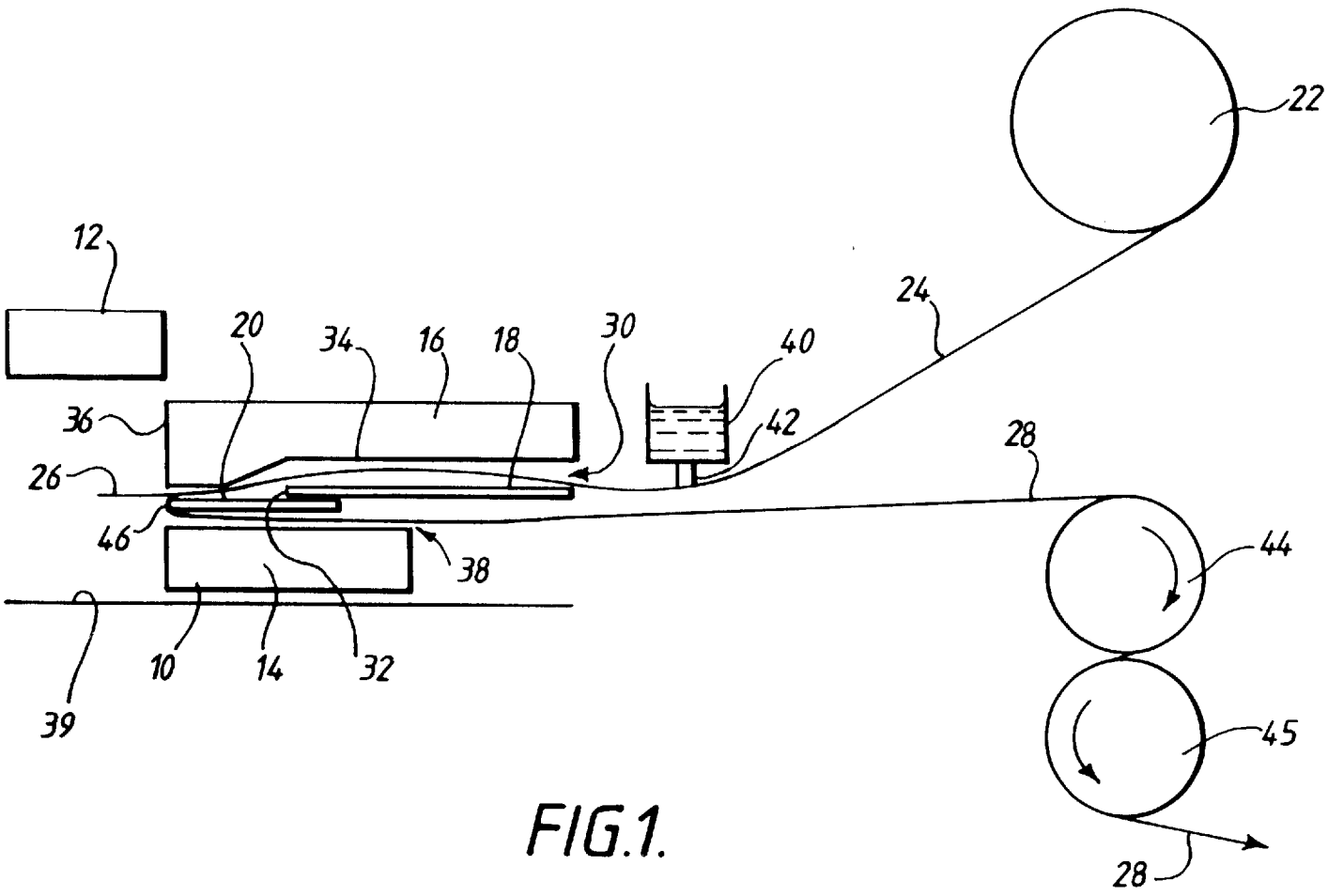
FIG. 1 is a schematic site elevation of an embodiment of the present invention.

An embodiment of the invention will now be described by way of example and with reference to the accompanying drawing, which is a schematic side elevation of the apparatus of the embodiment.

DESCRIPTION OF THE PREFERRED EMBODIMENT

The apparatus 10 is an adapted Faustel D17 Edger machine. The apparatus 10 comprises upper and lower dies 12,14, a block 16, a guide plate 18 and an extension plate 20. A roll 22 of substrate sheet material 24 is provided. The substrate sheet material 24 comprises a cutting strip material 26 which is entirely coated with adhesive on one side, the adhesive being covered by a release paper 28. The cutting strip material 26 may be a paper, acrylic resin and urea formaldehyde mix with other degradable resins. The material may include paper as a structural filler in an amount of about 65%. A suitable material is the material reference 700 SNS available from Armabord Limited in a thickness of 0.3 to 0.35 mm. (Alternatives are 700 INS, 300 SNS and 300 INS).

The block 16 and guide plate 18 define a shallow horizontal slot 30 between them. At the front edge 32 of the guide plate 18, the lower surface 34 of the block 16 is angled downwardly and then continues horizontally to its front face 36. The extension plate 32 is connected to the underside of the guide plate 18 and extends forwardly to adjacent the front face 36 of the block 16. The lower die 14 is stationary and is fixed beneath the guide plate 18 and extension 20 to leave a slot 38 therebetween. The upper die 12 is movable vertically and moves past the front face 36 of the block 16 and the end of the extension plate 20 to cut against the lower die 14. The upper die 12 includes a row of bores (not shown) which are connected to a suction pump (not shown). The upper and lower dies, 12,14 have serrated cutting surfaces. An application surface 39 is provided under the upper die 12.

A trough 40 is provided in front of the entrance of the slot 30. The trough 40 includes a felt applicating pad 42 which is in communication with the interior of the trough. The trough contains a light evaporation oil such as Esso Bayol 35.

Two parallel drive rollers 44,45 are also provided in front of the slot 30. The upper roller 44 is arranged to be driven clockwise and the lower roller 45 is arranged to be driven anti-clockwise.

In use, substrate sheet 24 is withdrawn from the roll 22 and passed under the applicator pad 42 and into the slot 30. At the front edge 46 of the extension plate 20, the release paper 28 is peeled away from the cutting strip material 26 and folded around the front edge 46 and back through the slot 38. The release paper 28 is then wound clockwise over the upper drive roller 44 and anti-clockwise over the lower roller 45. Excess cutting strip material 26 is cut off. When the machine is operated, the drive rollers 44,45 will rotate through a pre-determined angle to pull the release paper 28. As the cutting strip material 26 is sufficiently stiff in relation to the adhesive force provided by the adhesive between the release paper 28 and the cutting strip material 26, the cutting strip material will peel away prom the release paper 28 at the front edge 46 of the extension plate 40 so that a portion of cutting strip material 26 protrudes from the slot 38 with its lower face carrying the adhesive. The upper die 12 is driven downwards and cuts the protruding cutting strip material 26 against the lower die 14. The cut strip is held onto the upper die 12 by the suction of the suction pump and is carried down to a carton blank waiting on the surface 29 to which it is affixed on contact by the adhesive on its lower surface. On retraction of the upper die 12, the drive rollers 44 rotate through a further angle to cause a further section of cutting strip material to extend from the slot 38 for cutting and application to a further card blank.

The light evaporation oil from the trough 40 lubricates the cutting action of the dies 12,14.

The components which have been added in comparison with a standard Faustel D17 Edger are the extension plate 20 and the trough 40. The drive rollers 44,45 would normally receive metal sheet feed material from a roll 22 which would be driven by the rollers 44,45 into the slot 30. The Faustel D17 Edger machine also includes pins which are mounted together with the upper die 12 and extend through bores in the block 16 and lower die 14 to perforate the metal material before it is cut and applied to a carton. These pins are removed in the adapted machine.

While a particular cutting strip material has been described, alternative materials will be apparent to the skilled man and are intended to be encompassed by this application. In particular the strip may be formed from any suitable reels of recyclable material coated on one side and in turn covered by a release paper. The strip can be any width, length and thickness that enables it to cut effectively. The strength of the strip may be controlled to pass one or more of the following tests:

a) Indent Test BS 6222 1988 Impact—No damage to surface b) Scrape Test BS 6222 1988—3.0 Newtons c) Flexibility (Width) 0.35 mm—A 19 mm Strip must bend around a 12.5 mm bar but crack over a 9.5 mm bar 0.4 & 0.45 mm—Must bend over a bar 20.0 mm d) bond Test BS 6250 Part 3—Grade 4

The material thus allows a tooth sharpness sufficient to penetrate the film to be cut. The strip may be printed upon.

We claim:

1. A serrated cutting strip for a carton, the strip comprising a paper or carton paperboard impregnated with urea formaldehyde.

2. A cutting strip as claimed in claim 1, wherein the paper or carton paperboard is also impregnated with acrylic resin.

3. A cutting strip as claimed in claim 1, wherein the impregnation adds 42.5 to 67.5% by weight of additional material.

4. A cutting strip as claimed in claim 1, wherein the strip comprises impregnated paper.

5. A serrated cutting strip for a carton, the cutting strip comprising a mix of acrylic resin and urea formaldehyde with a 60 to 70% by weight of a structural filler.

6. A cutting strip as claimed in claim 1, wherein the structural filler is paper.

7. A cutting strip as claimed in claim 1, wherein the strip had adhesive on one side thereof and has a release sheet over the adhesive.

* * * * *